United States Patent [19]

Tokumoto et al.

[11] 4,049,507

[45] Sept. 20, 1977

[54] ELECTRODEPOSITING METHOD

[75] Inventors: Shin-Ichi Tokumoto; Eiji Tanaka; Kenji Ogisu; Tadao Fujita, all of Yokohama, Japan

[73] Assignee: Sony Corporation, Tokyo, Japan

[21] Appl. No.: 613,513

[22] Filed: Sept. 15, 1975

[30] Foreign Application Priority Data

Sept. 18, 1974 Japan ..... 49-107500

[51] Int. Cl.[2] ..... C25D 3/66

[52] U.S. Cl. ..... 204/39; 204/273; 204/DIG. 9

[58] Field of Search ..... 204/273, 212, 39, 64 T, 204/DIG. 9

[56] References Cited

U.S. PATENT DOCUMENTS

| | | | |
|---|---|---|---|
| 1,513,119 | 10/1924 | Madsen | 204/212 X |
| 2,744,860 | 5/1956 | Rines | 204/45 R |
| 2,786,808 | 3/1957 | Raney | 204/64 T X |
| 2,838,393 | 6/1958 | Dean | 204/39 X |
| 2,874,454 | 2/1959 | Gullet | 204/39 X |
| 2,881,119 | 4/1959 | Goldenberg | 204/39 |
| 2,935,454 | 5/1960 | Tokumoto | 204/64 T |
| 3,706,651 | 12/1972 | Leland | 204/212 X |
| 3,715,299 | 2/1973 | Anderson et al. | 204/212 |
| 3,798,056 | 3/1974 | Okinaka et al. | 204/212 X |
| 3,849,277 | 11/1974 | Miyata et al. | 204/212 X |

FOREIGN PATENT DOCUMENTS

| | | | |
|---|---|---|---|
| 17,126 | 4/1965 | Japan | 204/DIG. 9 |

*Primary Examiner*—G. L. Kaplan

*Attorney, Agent, or Firm*—Lewis H. Eslinger; Alvin Sinderbrand

[57] ABSTRACT

An electrodeposition method of electrodepositing a material with a flat and smooth surface, in which an electrolytic condition such as a speed of movement of a cathode relative to an electrolyte, an electrolytic current density, a duty ratio of an interrupted electrolytic current or an interruption frequency of an electrolytic current is changed periodically from a normal value to another value and back again.

4 Claims, No Drawings

ELECTRODEPOSITING METHOD

BACKGROUND OF THE INVENTION

1. Field of the Invention

The present invention relates generally to an electrodeposition method, and is directed more particularly to a method of electrodepositing metal or alloy by fusion electrolysis.

2. Description of the Prior Art

In Japanese Patent Nos. 212 080, 229 381, 294 943 and 726 754, electrodeposition methods using fused salt electrolysis were disclosed by the same inventors of the present invention and et al., in which methods the shape or contour of electrodeposited materials can be controlled as required, for example, made as a plate or block by utilizing electrolytic polarization.

With the above prior art electrodeposition methods, however, especially when a rotating cathode is used, a stationary flow pattern is apt to be caused in electrolyte on or adjacent to the surface of the cathode. This limits the range of electrolytic conditions over which good electrodeposition can be achieved, and in particular limits the time for which electrodeposition can be continued.

When the electrolytic conditions remain unchanged for a long time, traces are apt to be formed on the electrodeposited surface by the stationary flow pattern of the electrolyte and also projections are grown on the electrodeposited surface along the traces. This may be because when the electrolytic conditions are unchanged for a long time, the viscosity of a layer of polarized electrolyte on or adjacent to the cathode surface becomes different from that of the body of the electrolyte.

With the methods of all the above-mentioned Japanese patents electrodeposited material can grow well only in the layer of polarized electrolyte, so it does not grow well near projections where the layer of polarized electrolyte is easily removed.

SUMMARY OF THE INVENTION

It is an object of the invention to provide an electrodeposition method free from the defects of the prior art.

It is another object of the invention to provide an electrodeposition method with which the electrodeposition of a metal or alloy on the surface of a cathode can be continued for a substantial time, with the surface of the deposited metal or alloy remaining smooth.

It is a further object of the invention to provide a fused salt electrodeposition method in which an electropolarization is changed so as to keep a layer of polarized electrolyte stable for a substantial time.

It is a still further object of the invention to provide an electrodeposition method which is simple and stable in operation and with which a smooth electrodeposition and controlled shape electrodeposition can be carried out positively for a substantial time.

It is a yet further object of the invention to provide an electrodeposition method suitable for electrodeposition of a substantial thickness of titanium or titanium alloy.

According to the present invention there is provided an electrodeposition method in which at least one of a speed of movement of a cathode relative to an electrolyte, an electrolytic current density, a duty ratio of an interrupted electrolytic current and an interruption frequency of an electrolytic current is changed periodically from a normal value to another value and back again.

DESCRIPTION OF THE PREFERRED EMBODIMENTS

The objects, features and advantages of the invention will become apparent from the following description.

An electrodeposition method according to the present invention will now be described. The method uses fused salt electrolysis, and an electrolytic condition such as the relative speed of movement between a cathode and an electrolyte, an electrolytic current density, an electrolytic current duty ratio or interrupting ratio, or an electrolytic current interruption frequency is periodically changed from an original or normal value to some other value and back.

By way of example, the fact that the speed of movement of an electrodeposition surface relative to the electrolyte is decreased from the normal value is equivalent to the fluid-dynamic boundary layer produced on said surface being made thicker. As a result, the layer of polarized electrolyte adjacent to said surface becomes thicker. At the same time, the composition of the electrolyte in the polarized portion becomes appreciably different from that of the original electrolyte. With this kind of electrodeposition method as hitherto used, the electrolyte is such that the electrodeposited material grows well only in the layer of polarized electrolyte, but not on projections where the polarized layer is easily removed, so that lumps grow on the electrodeposition surface. In other words, the electrodeposition surface produced by decreasing the speed of movement of the electrodeposition surface relative to the electrolyte is rather rich in concaves and convexes as compared with that produced by the high relative speed or in a thin layer of polarized electrolyte.

Next, the speed of the electrodeposition surface relative to the electrolyte is increased to return to the normal value. The concave and convex portions formed on the electrodeposition surface during the time within which the relative speed is low are removed by returning the relative speed to the normal value and so the electrodeposition surface becomes more flat. The above operations are repeated periodically so making it possible to continue electrodeposition for a long time.

References to be compared with the present invention and Examples of the invention will now be described.

In all the References and Examples, an internally heated electrolytic bath of square shape is used and an electrolyte is charged therein to such an extent that the depth of the electrolyte is 85 cm, or 130 liters of electrolyte is charged into the bath. The atmosphere over the electrolyte is argon and the electrolyte is stirred by a propeller made of stainless steel. The composition of the electrolyte by weight ratio in a region of the electrolyte which extends from 5 cm to 15 cm below the surface of the electrolyte and into which a cathode is inserted is, at the electrolytic temperature of from 451° C to 455° C, as follows:

| | |
|---|---|
| $BaCl_2$ | 21.5 |
| $MgCl_2$ | 22.8 |
| $CaCl_2$ | 13.1 |
| NaCl | 12.3 |
| KCl | 9.3 |
| $TiCl_2$ | 15.3 |
| $TiCl_3$ | 0.5 |

The analysis of titanium dichloride and titanium trichloride in the electrolyte is carried out by the method disclosed in the Journal of Metals 266, 1957 By S. Mellgrem and W. Opie. This method is based on the fact that the titanium dichloride quantitatively produces hydrogen gas in a dilute acid solution. The chemical reaction is as follows:

$$Ti^{+2} + H^{+} \rightarrow Ti^{+3} + \frac{1}{2}H_2 \uparrow$$

The quantitative analysis of titanium dichloride is carried out by measuring the amount of hydrogen produced, and the above analyzing method for titanium dichloride will be hereinbelow referred to as a hydrogen method. To use this method, the electrolyte at the operating temperature is sampled, the sampled material is then cooled rapidly to produce a specimen, the specimen is placed in a 0.7% aqueous solution of hydrochloric acid, the amount of hydrogen produced is measured, and the titanium dichloride in the electrolyte is determined quantitatively on the assumption that the hydrogen produced is due to the presence of titanium dichloride.

On the other hand, the analysis of titanium trichloride is somewhat different. The above specimen is dissolved in a 0.5% aqueous solution of hydrochloric acid, the barium salt is removed therefrom with a 10% aqueous solution of sulfuric acid, titanium ions which can be reduced are all reduced to $Ti^{+3}$ with zinc amalgam and are then titrated with standard $Fe^{+3}$ solution, and the amount of titanium dichloride measured quantitatively by the above hydrogen method is subtracted from the titanium salt obtained as titanium trichloride by the titration to determine quantitatively the existing amount of titanium trichloride.

A rotary cathode is used in the electrodeposition methods, this comprising a pipe made of stainless steel, which is 100 mm in length, 32 mm in outer diameter and 1.5 mm in thickness. The pipe is attached through an electrically conductive ring made of steel to the end of a rotary shaft having an outer diameter of 25 mm and made of stainless steel. The other end of the pipe is covered by a ceramic nut. The cathode is immersed in the electrolyte in such a manner that the pipe extends substantially vertically in the electrolyte between 5 and 10 cm from the surface of the electrolyte with the ceramic nut at the bottom. In use the cathode is rotated in the electrolyte by rotation of the rotary shaft. That portion of the shaft which is above the upper end of the pipe but under the surface of the electrolyte is covered with a ceramic cylinder, whose outer diameter is substantially the same as that of the pipe, for electrically insulating the rotary shaft from the electrolyte.

Two carbon plates of square shape, 20 cm by 20 cm and 1.5 cm in thickness, are used as anodes. The two carbon plates are located in the electrolyte so as to be symmetrical with respect to the cathode pipe on respective sides thereof and each at a distance of 15 cm from the pipe.

Each of the carbon anodes is substantially covered with a bag-shaped partition diaphragm made of twilled quartz to prevent the composition of the electrolyte from being changed with the products produced at the anodes by anodic reaction during the electrolysis. There is a distance of about 3 cm between the surface of the anode and the respective partition diaphragm.

Further, in order to measure the polarization on the surface of the cathode, a carbon rod with a diameter of 8 mm is immersed in the electrolyte as a neutral electrode for comparison, in such a manner that it faces the cathode at a distance of about 12 cm and at a depth of 15 cm in the electrolyte on a side of the cathode not facing an anode.

References, and Examples according to the present invention, which will be described now, are obtained with the apparatus described above.

REFERENCE 1

1. The cathode is rotated at 2300 r.p.m.;
2. The electrolytic current is interrupted 100 times per minute, the duty ratio, that is ratio between current supplying time and current interrupting time is selected as 3:2, and the cathode current density during the current supplying time is 17.5 A/dm$^2$; and
3. The duration of electrolysis is 30 minutes.

With these conditions the electrodeposited surface is almost semi-glossy and flat, but there appear on the electrodeposited surface ring-shaped grooves which are slightly concave in the direction perpendicular to the axis of the rotary shaft of the cathode, the grooves being at a substantially equal pitch of about 0.6 mm.

REFERENCE 2

1. The rotation is the same as condition (1) of Reference 1;
2. The current is the same as condition (2) of Reference 1; and
3. The duration of electrolysis is 2 hours.

With these conditions there are produced distinct ring-shaped grooves in the direction perpendicular to the axis of the rotary shaft of the cathode at a substantially equal pitch of about 0.6 mm. There are also observed projections grown on and arranged along the extending direction of the projected portions between the adjacent grooves, these projections being round on their top ends and of large diameter.

EXAMPLE 1

1. The cathode is rotated at 2300 r.p.m. for 20 seconds and then at 250 r.p.m. for 10 seconds, this being repeated alternately. The transition time during which the speed changes from one value to the other is about 2.5 to 3 seconds;
2. The current is the same as condition (2) of Reference 1; and
3. The duration of electrolysis is 3 hours.

With these conditions, although the duration of electrolysis is substantially longer than in References 1 and 2, the electrodeposited surface is deteriorated little in gloss as compared with that of Reference 1 in which the duration of electrolysis is only 30 minutes, but the electrodeposited surface is flat with no projections and grooves.

Thus Example 1 of the invention shows that with this method, the defects of the electrodeposited surface encountered in References 1 and 2 can be eliminated by periodically changing the rotational speed of the cathode. Further, it will be apparent without further description that a suitable value may be determined for the ratio between changing speed and switching time of the rotational speed by the composition of a used electrolyte, electrolytic temperature, electrolytic current density, duty ratio, interrupting frequency and so on when the electrolytic current is interrupted. In general, when the speed of movement of an electrodeposited surface relative to an electrolyte is periodically reduced by a factor ranging from the reciprocal of a small integer to one tenth or less of the original speed, desired effects can be obtained.

EXAMPLE 2

1. The cathode is rotated at 2300 r.p.m.;
2. The electrolytic current is interrupted 100 times per minute, the duty ratio, that is the ratio between the time within which the electrolytic current flows (on-time) and the time within which no electrolytic current flows (off-time) is selected as 3:2 and the cathode current density during the former time is changed alternately between 30 A/dm$^2$ and 17.5 A/dm$^2$. In this case, the conduction time is set for 50 seconds; and
3. The duration of electrolysis is 2 hours.

With these conditions the electrodeposited surface is semi-glossy and with no grooves.

EXAMPLE 3

1. The cathode is rotated at 2300 r.p.m.;
2. The electrolytic current is interrupted 100 times per minute, the duty ratio, that is the ratio between the on-time and off-time being 1:1 and 3:1 repeated alternately for 80 seconds. In this case, the cathode current density during the on-time is 17.5 A/dm$^2$; and
3. The duration of electrolysis is 2 hours.

With these conditions the electrodeposited surface is grey and flat.

EXAMPLE 4

1. The cathode is rotated at 2300 r.p.m.;
2. The electrolytic current is interrupted, the interruption frequency being 30 times per minute for 67 seconds and then 400 times per minute for 33 seconds, repeated alternately. In this case, the duty ratio, that is the ratio between the on-time and off-time is 3:2 in each case and the cathode current density during the on-times is 17.5 A/dm$^2$; and
3. The duration of electrolysis is 2 hours.

With these conditions the electrodeposited surface is light grey and flat.

In the above Examples, it is noted that if a voltage read on an oscilloscope, to which the neutral electrode and the cathode are connected at every time when no current flows, is controlled to show a voltage difference between 0.005 V and 0.1 V, preferably a voltage difference between 0.005 V and 0.05 V during the treating period for increasing the polarization and during the treating period for decreasing the polarization, a desired electrodeposited surface can be obtained relatively stably and positively.

With the electrodeposition methods described in the Examples above, the electrodeposition of a flat or shape controlled electrodeposited surface can be carried out stably and positively for a long period of time, or thicker deposition can be obtained. The mechanism used is that the layer of polarized electrolyte formed on the electrodeposited surface is changed with a suitable periodicy, the changes affecting the thickness or biasing degree of the layer. Accordingly, other methods by which the thickness of polarization or the biasing degree of polarization is adjusted in accordance with the objects of the invention are contained within the scope of the invention.

Further, the apparatus described above employs a cathode which is rotated on the single shaft, but it may be also possible that the rotary shaft to which the cathode is attached for rotation is subjected to a precession in addition to its own rotation to produce periodically components perpendicular to the surface of the cathode in the flow of the electrolyte relative to the surface, and hence to form on the whole surface of the cathode electrode a uniform electrodeposited layer. In this case, the precession which produces much preferred results without changing the conditions at the above Examples 1 to 4 of the invention is such that it is 1 cm in radius at the cathode and its periodicy is 100 per minute. In this case, if both of or one of the radius and period of the precession is increased, the boundary layer or diffusion layer adjacent to the surface of the cathode can be made thinner. As a result, it will be understood without further description that the amount of electrolytic current per unit time can be increased.

It may be apparent that many modifications and variations could be effected by one skilled in the art without departing from the spirit or scope of the novel concept of the present invention.

We claim:

1. In the method of electrodepositing titanium onto a cathode immersed in a fused salt bath electrolyte by passing an electrolyzing current between an anode also immersed in said electrolyte and said cathode while intermittently interrupting said electrolyzing current and effecting relative movement between said cathode and said electrolyte; and in which the speed of said relative movement, the density of said electrolyzing current, the frequency at which said electrolyzing current is intermittently interrupted and the duty ratio of the periods during which said electrolyzing current is passed and interrupted, respectively, are parameters affecting the electrodeposition of the titanium on said cathode; the improvement of rotating said cathode so as to effect said relative movement, and substantially changing at least said speed of relative movement periodically in a repeating cycle between a first value and a substantially different second value throughout the time during which titanium is being electrodeposited on the cathode.

2. The method according to claim 1; in which said relative movement is effected also by precessing said cathode while rotating the latter.

3. The method according to claim 1; in which said second value is from ½ to 1/10 said first value.

4. The method according to claim 3; in which, during each said repeating cycle, said speed of relative movement is at said first value for a time which is approximately twice the time during which said speed is at said second value.

* * * * *